United States Patent [19]

Lewis

[11] 4,136,667

[45] Jan. 30, 1979

[54] OVEN DOOR LATCH MECHANISM

[75] Inventor: Walter E. Lewis, Louisville, Ky.

[73] Assignee: General Electric Company, Louisville, Ky.

[21] Appl. No.: 780,793

[22] Filed: Mar. 24, 1977

[51] Int. Cl.[2] ..... E05C 19/12

[52] U.S. Cl. ..... 126/197; 292/DIG. 69; 292/108

[58] Field of Search ..... 126/197; 292/DIG. 66, 292/DIG. 69, 108, 210; 219/400, 403, 404, 413

[56] References Cited

U.S. PATENT DOCUMENTS

| | | | |
|---|---|---|---|
| 26,944 | 8/1970 | Getman | 219/413 |
| 3,313,918 | 4/1967 | Barber | 126/197 |
| 3,362,398 | 1/1968 | Fane, Jr. | 126/273 |
| 3,540,767 | 11/1970 | Siegel | 126/197 |
| 3,815,942 | 6/1974 | White | 292/113 |
| 3,831,580 | 8/1974 | McLean | 126/197 |

*Primary Examiner*—John J. Camby
*Assistant Examiner*—Larry I. Schwartz

[57] ABSTRACT

A pyrolytic self-cleaning oven has an oven door latch mechanism with an elongated latch arm that has a shifting pivot means and a tapered latch hook so the latch mechanism will cause the compression of the door gasket for sealing the oven cavity during the self-cleaning cycle. There is a locking means for the latch mechanism which functions when the door is locked and the oven temperature is above normal cooking temperatures. The locking means includes a bimetal actuator that senses the temperature of the oxidation unit in the oven exhaust system.

15 Claims, 5 Drawing Figures

OVEN DOOR LATCH MECHANISM

BACKGROUND OF THE INVENTION () Field Of The Invention

This invention relates to high temperature self-cleaning ovens, and particularly to an oven door latch mechanism so the oven door may be sealed during a self-cleaning oven cycle, and the door can only be opened after the oven temperature returns to the normal cooking temperature range.

(2) Description Of The Prior Art

The present invention relates to a door latching mechanism for a door of a high temperature self-cleaning oven of the general type as is described in the basic patent of Bohdan Hurko, U.S. Pat. No. 3,121,158 which issued on Feb. 11, 1964, which is also assigned to the present assignee.

Such a self-cleaning oven would have a normal cooking function of baking and broiling within the temperature range between about 150° F. and 550° F., as well as a self-cleaning cycle where the oven air temperature is raised to a maximum somewhere between about 750° F. and about 950° F. for degrading and removing the food soil and grease spatter that accumulates on the walls of the oven liner during normal cooking. Such a reaction may be characterized by the term pyrolysis, which means the chemical decomposition of matter by the application of heat.

The present invention is concerned with means for ensuring that the oven door is both closed and latched before the self-cleaning oven cycle can be initiated, as well as to ensure that the oven door cannot be unlocked as long as the oven air temperature is above the maximum normal cooking temperature.

An early patent in this art is U.S. Pat. No. Re. 26,944 to Clarence Getman, which is also assigned to the present assignee. This Getman patent discloses a self-cleaning oven with a manual door latch mechanism, and automatic means for locking the latching mechanism. A solenoid is furnished and it is capable of overriding the locking means so that the door latching means may be operated. The solenoid control circuit is governed by a momentary switch and a thermostatic switch that is opencircuited above normal cooking temperatures.

An early attempt to replace the solenoid locking system for the door latching mechanism is described in the William Fane U.S. Pat. No. 3,362,398, which is also assigned to the present assignee. This patent utilizes a thermally responsive locking means for engaging the door latching mechanism. This locking means is represented by a bimetal disc positioned within the oven cooking cavity for operating a pivoted bolt member.

A patent showing a bimetal-operated door latching mechanism is described in the patent of Jean-Claude Lafforgue, U.S. Pat. No. 3,440,403. This door latching mechanism is not a manual latching mechanism but one that is controlled by a large bimetallic member. A heating element is arranged adjacent the bimetallic strip so as to give quick response to the latch member.

Another patent showing a thermally responsive locking means for an oven door latching mechanism is described in the patent of James White, U.S. Pat. No. 3,815,942, which is also assigned to the present assignee. This locking means comprises a single-point thermostat having a temperature sensing probe located within the oven cooking cavity. The thermostat has a snap-acting responder which controls a pawl for locking the latch mechanism.

The principal object of the present invention is to provide an oven door latching mechanism for a self-cleaning oven with a thermally-operated locking means which is accurately responsive to oven temperatures above normal cooking temperatures, and which will also unlock the door latching mechanism soon after the cleaning cycle has terminated.

A further object of the present invention is to provide an oven door latching mechanism of the class described wherein the thermally responsive locking means is associated with the oxidation unit of the oven exhaust system.

A further object of the present invention is to provide an oven door latching mechanism of simplified structure with a shifting pivot means.

A further object of the present invention is to provide an oven door latching mechanism of the class described wherein the latch handle may be operated between open and closed positions without the oven being connected to a source of electrical power.

A further object of the present invention is to provide an oven door latching mechanism of the class described wherein the latch will not remain in the circuit actuated position if the oven door is not closed.

SUMMARY OF THE INVENTION

The present invention, in accordance with one form thereof, relates to a high-temperature, self-cleaning oven having an oven door latching mechanism and a thermally-responsive locking means for the door latching mechanism which is operable when the oven temperature is above about 600° F. so as to render the latching mechanism inoperable until the oven temperature returns to a temperature below about 600° F. The thermally-responsive locking means is associated with the oxidation unit of the oven exhaust system.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
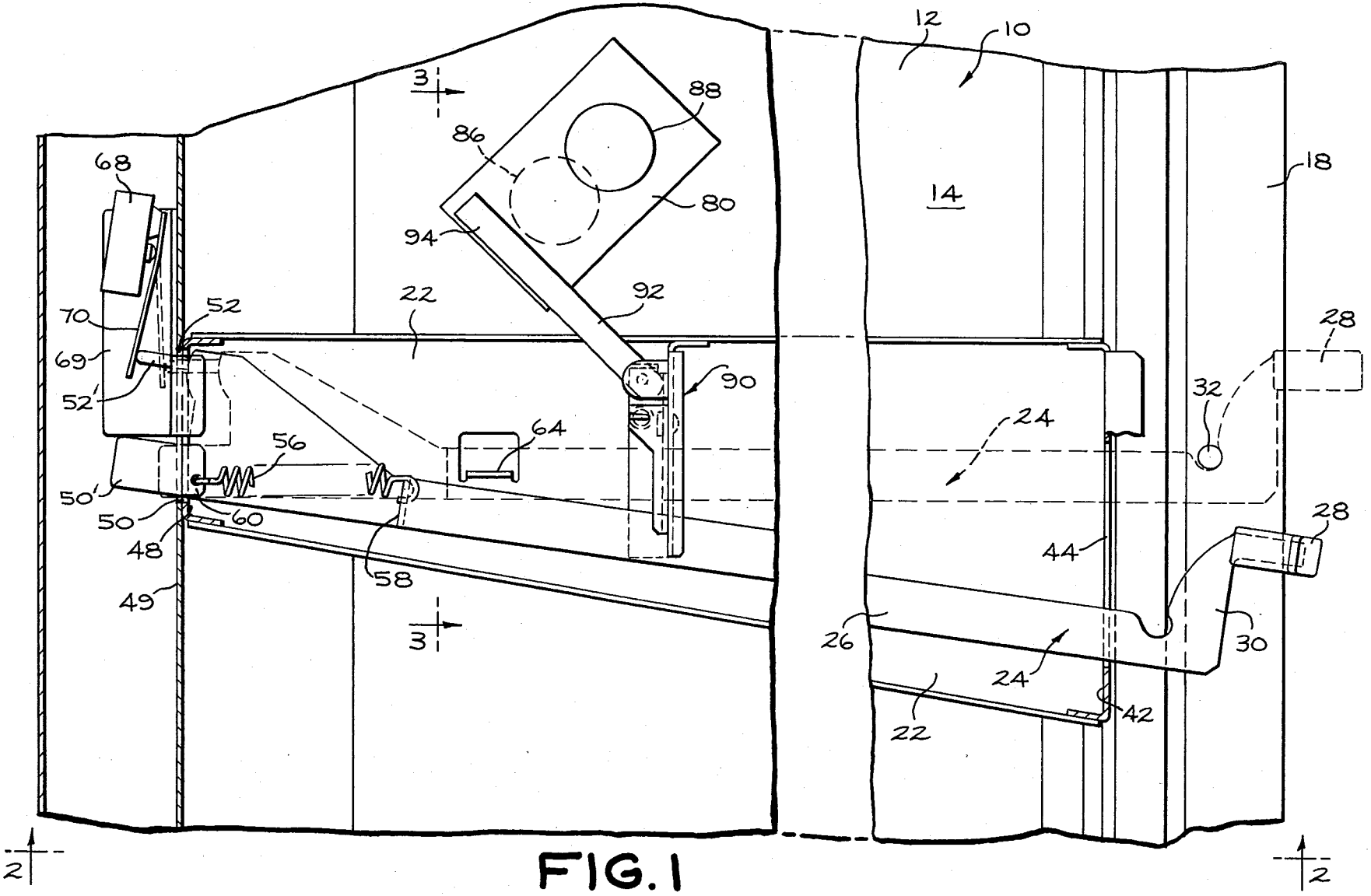
FIG. 1 is a fragmentary, cross-sectional plan view of the oven door latching mechanism of the present invention showing the latch arm in solid lines in the open position, and the same latch arm in dotted lines in the fully-closed position.

Turning now to a consideration of the drawings, and in particular to FIG. 1, there is shown a fragmentary top plan view of an electric baking and broiling oven 10 which is provided with a self-cleaning oven cycle. The oven insulation and the overlying cooktop have been removed for ease in understanding the nature of the oven door latching mechanism. This oven is formed with a box-like oven liner 12, only the top wall 14 of which is shown. The open front of the oven liner is adapted to be closed by an oven door 18, which happens to be a hinged-down, front-opening door of standard construction for a self-cleaning oven. Mounted above the top wall 14 of the oven liner 12 is a large base plate 22 for an oven door latching mechanism 24. This base plate 22 extends from front to back of the oven liner. The main element of the oven door latching mechanism is an elongated latch arm 26.

Figure 2:
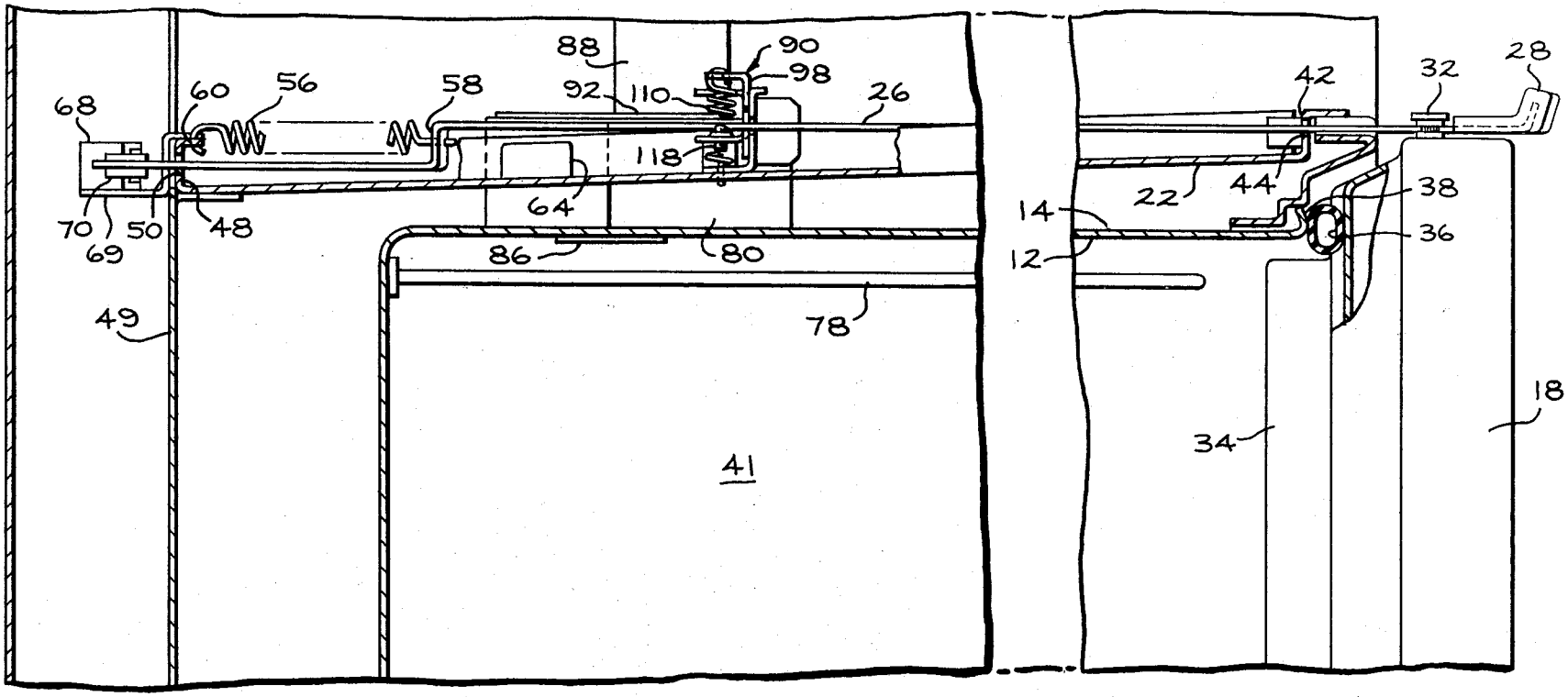
FIG. 2 is a fragmentary, cross-sectional elevational view taken on the line 2—2 of FIG. 1 showing the upper portion of a self-cleaning oven with the oven door closed and latched.

The front portion of the latch arm 26 has a handle 28 that is mounted on a tapered hook portion 30 that is in turn adapted to engage a keeper post 32 on the top edge of the oven door 18, as is seen in both FIGS. 1 and 2. Looking at the side elevational view of FIG. 2, the oven door 18 is shown as being of hollow sheet metal construction having an inner pluglike portion 34 which fits closely into the front opening of the oven liner 12. The oven door 18 carries a door sealing gasket 36, of woven fiber glass or the like, which is adapted to bear against a front flange 38 of the oven liner for sealing the gap when pressure is applied between the oven door and oven liner when the door is latched during the self-cleaning oven cycle. The purpose of the tapered hook portion 30 of the latch arm 26 is to pull in on the oven door 18 when the latch handle 28 is moved to its dotted line, fully-closed position of FIG. 1, so as to compress the gasket 36 and restrict movement of air into or out of the oven cooking cavity 41 during the self-cleaning cycle.

Returning to the top plan view of FIG. 1, the front portion of the base plate 22 has a turned-up flange 42 with a horizontal elongated slot 44 through which the latch arm 26 protrudes and is guided thereby. The rear portion of the base plate 22 also has a turned-up flange 48 which is mounted to a rear, vertical insulation guard 49. The flange 48 is provided with a pair of spaced, horizontal slots 50 and 52, where these slots lie in substantially a common plane. The rearmost end of the latch arm 26 is provided with a pair of tabs 50′ and 52′ which are adapted to protrude through the slots 50 and 52, respectively, and are guided thereby. The tab 50′ is substantially in alignment with the longitudinal axis of the latch arm 26, while the second plunger 52′ is offset to the side from the longitudinal axis of the latch arm. A heavy-duty latch arm spring 56 is attached at one end to the latch arm by means of a riser 58, and is stationary at the other end by being attached to a horizontal extension 60 of the rear flange 48. This extension 60 generally overlies the rearmost end of the latch arm when the latch arm is in its fully-open position, as shown in solid lines in FIG. 1. The rearmost end of the latch arm 26 serves as a rocking pivot means for the latch arm to replace a standard pivot pin which would otherwise be used. The first plunger 50′ functions as the rolling bearing for the latch arm when the latch arm 26 is in its fully-open position. As the latch arm moves from the fully-open position toward the fully-closed position, the second plunger 52′ comes into action and serves as the rolling bearing, which allows the tapered hook portion 30 of the latch arm to swing out and catch the keeper post 32 of the door, and pull in on the door for compressing the door gasket 36. The action of the latch arm spring 56 is to normally urge the latch arm 26 to its fully-open position such that the position of the latch arm during normal cooking will be in the fully-open position shown in solid lines in FIG. 1. Thus, if the oven door 18 is not closed when the handle is moved toward a closed position, the tapered hook portion 30 will not engage the keeper post 32, and thus when the operator's hand is removed from the handle 28 the latch arm will automatically return to its fully-open position due to the tension force exerted by the latch arm spring 56. A fixed stop 64 is mounted on the base plate 22 in the path of movement of the vertical riser 58. This fixed stop 64 serves to prevent the operator from pulling the oven door 18 open against the restraining force of the latch arm spring 56.

Associated with the latch arm 26 is an interlock switch 68 at the back of the oven which is a normally open, single-pole, single-throw switch that is adapted to be closed when the latch arm 26 engages the oven door 18 in the fully-closed position. The interlock switch 68 is supported from a mounting bracket 69 that is attached to the insulation guard 49. This switch 68 has a switch actuator 70 which is in contact with the second plunger 52′ of the latch arm 26. When the latch arm 26 is in its fully-closed position, the plunger 52′ moves the switch actuator 70 to close the interlock switch 68.

Figure 5:
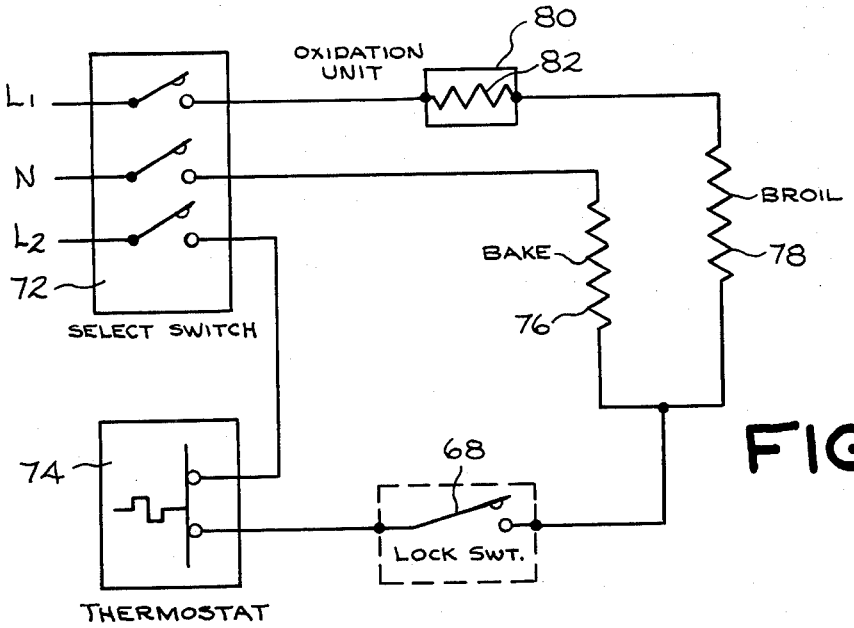
FIG. 5 is a fragmentary, schematic diagram of the power circuit that is used during a self-cleaning oven cycle.

A fragmentary schematic diagram of the power circuit for the self-cleaning oven cycle only is shown in FIg. 5. There is an oven selector switch 72, an oven thermostat 74, a lower oven bake element 76, and an upper oven broil element 78, and an oxidation unit 80 having an electrical heating element 82. The oxidation unit is located in the oven exhaust system for further degrading the gaseous degradation products which are created during the self-cleaning oven cycle. Of course, the oven selector switch 72 is a multiple selector switch having a BAKE, BROIL, TIME BAKE and a CLEAN position, but is merely shown with the single position used during the self-cleaning oven cycle. The oven thermostat 74 is a dual-range thermostat to control temperatures between 150° F. and 950° F. but it is illustrated as an overtemperature thermostat that is usually set at a maximum temperature somewhere between about 750° F. and 950° F. In actual practice, an acceptable maximum temperature has been chosen at around 880° F., which allows for an expected temperature variation of ± 70° F. The heating element 82 in the oxidation unit 80 is shown in series with the broil element 78 and in parallel with the bake element 76, so that the oxidation unit is always energized when the power circuit for the self-cleaning oven cycle is energized. As a general rule, the heating element 82 of the oxidation unit 80 is not energized during normal cooking temperatures as it is not necessary.

Returning to a consideration of the plan view of FIG. 1, the oxidation unit 80 is shown mounted outside of the oven liner 12, and on top of the top wall 14. The top wall 14 has a first vent opening 86 over which the oxidation unit 80 is positioned. The top portion of the oxidation unit 80 has an exhaust opening 88 which is vertically offset from the first exhaust opening 86, and this exhaust opening 88 discharges under a surface heating unit (not shown) in the cooktop that would overlie the oven in a free-standing range.

Figure 3:
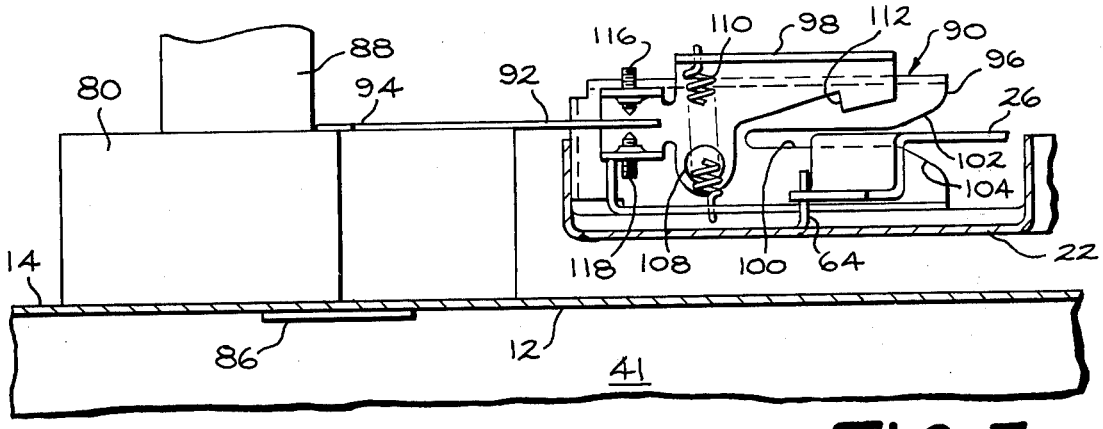
FIG. 3 is a fragmentary, cross-sectional view taken on the line 3—3 of FIG. 1 showing the thermally-responsive means or bimetal mounted on the oxidation unit or smoke eliminator of the oven exhaust system and cooperating with a snap-acting catch means for locking the latch arm.
Figure 4:
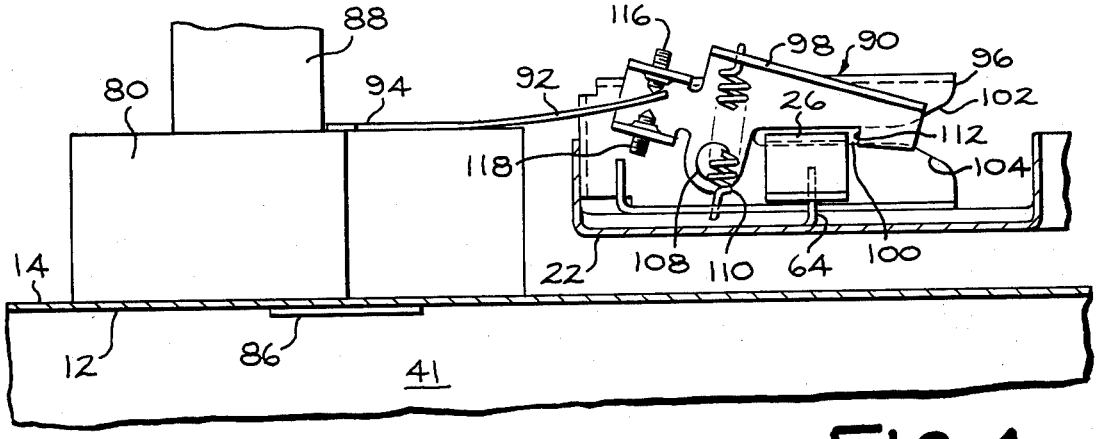
FIG. 4 is a view very much like that of FIG. 3, except the latch arm has moved into its closed position, and the temperature of the oxidation unit has caused the bimetal to actuate the catch member and lock the latch arm.

A locking means 90 is positioned on the base plate 22 for cooperation with the latch arm 26. Associated with this locking means 90 is a bimetal cantilever blade 92 that is fastened at one end 94 to the top of the oxidation unit 80. Now attention is directed to FIG. 3, which best shows the nature of the locking means 90. This locking means 90 comprises three main elements; namely, a latch arm guide 96, a pivoted catch member 98, and the bimetal blade 92. The latch arm guide 96 is a vertical plate having a horizontal slot 100 with diverging entrance slopes 102 and 104. The latch arm 26 is adapted to slide into and out of the elongated slot 100 in the latch arm guide 96. The catch member 98 is pivoted about a generally central, lower hinge pin 108. And there is a vertical overcenter toggle spring 110 which is fastened at one end to the bottom of the latch arm guide 96 and at the other end to the top edge of the catch member 98. The catch member includes a hook portion 112 which is adapted to engage the far edge of the latch arm 26 after the latch arm is in its fully-closed position, and after the oven temperature has been heated above normal cooking temperatures. The end of the catch member 98 that is opposite the hook portion 112 is provided with a pair of vertical, opposing, calibrating screws 116 and 118 which are spaced apart a given amount and receive the free end of the bimetal blade 92 therebetween. As is clear from FIG. 4, when the oxidation unit 80 is heated above about 600° F., the bimetal blade 92 will deflect upwardly, engaging the top calibrating screw 116 and causing the catch member 98 to pivot about its hinge pin 108 until the toggle spring 110 takes over and causes a snapaction of the hook portion 112 of the catch member 98 to engage the far edge of the latch arm 26. When the self-cleaning cycle is complete and the oven heating elements and oxidation unit are de-energized, the oven and oxidation unit will begin to cool down. When the temperature of the oxidation unit reaches about 600° F., the bimetal blade will have returned to the position of FIG. 3 and the catch member 98 will release the latch arm 26.

Modifications of this invention will occur to those skilled in this art; therefore, it is to be understood that this invention is not limited to the particular embodiment disclosed, but that it is intended to cover all modifications which are within the true spirit and scope of this invention as claimed.

What is claimed is:

1. A high temperature self-cleaning oven comprising a boxlike oven liner and a front-opening access door, heating means for the oven, a latch mechanism for locking the door, said latch mechanism comprising an elongated latch arm that is movable between an open and a closed position, the top portion of the door including a keeper that is engageable by the latch arm, the oven liner including an oxidation unit in cooperation with an exhaust vent for removing the gaseous degradation products during a self-cleaning oven cycle, and a locking means engageable with the latch arm in the closed position when the oven temperature is above about 600° F. so as to render the latch arm inoperable until the oven temperature returns to a temperature below about 600° F., said locking means comprising a thermally responsive means operative in response to the temperature of said oxidation unit and joined with a catch means which when actuated by the thermally responsive means confines the latch arm from further movement at oven air temperatures above about 600° F.

2. A high temperature self-cleaning oven as recited in claim 1 wherein the elongated latch arm has a shifting pivot means adjacent the rear of the oven, the front portion of the latch arm having a handle portion and a tapered hook portion, said keeper adapted to be engaged by said tapered hook portion, a resilient door gasket for sealing the gap between the door and the oven liner, the shifting pivot means including a first pivot generally in alignment with the latch arm for use in the open position of the latch arm, and a second off-center pivot for use as the latch arm is moved toward its closed position.

3. A high temperature self-cleaning oven as recited in claim 2 wherein the said latch mechanism has a supporting base plate that is assembled above the oven liner, the shifting pivot means of the latch arm comprising an upright flange at the rear of the base plate having a pair of slots arranged in a generally horizontal plane, the rear end of the latch arm having a spaced pair of plungers which extend into the slots and are guided thereby for a rocking action with respect to the flange, one plunger being generally in alignment with the latch arm for use as a bearing by the latch arm in its open position, and the second plunger being arranged off-center from the latch arm for use as a bearing by the latch arm in a position other than the open position.

4. A high temperature self-cleaning oven as recited in claim 1 wherein the said catch means is furnished with a stabilizing guide means into which the latch arm slides in the closed position, the catch means being a pivoted hook member that is supported from the guide means and is engageable over the far edge of the latch arm to confine it within the guide means.

5. A high temperature self-cleaning oven as recited in claim 4 wherein the said catch means includes an overcenter spring means for urging the catch to either of its two extreme positions, the catch means also including adjustable calibration means for cooperation with the said thermally responsive means.

6. A high temperature self-cleaning oven as recited in claim 4 wherein the said oxidation unit is provided with a resistance heating element that is energized only during a self-cleaning oven cycle, the said thermally responsive means being a cantilever bimetal blade that is supported from the housing of the oxidation unit and has its free end interposed between the said adjustable calibration means of the catch means.

7. A high temperature self-cleaning oven as recited in claim 1 wherein the latch arm is furnished with a return spring means which urges the latch arm toward its open position, and a fixed stop means in the path of movement of the latch arm to prevent the travel of the latch arm beyond its fully closed position in the event the oven door is open.

8. A high temperature self-cleaning oven as recited in claim 3 wherein an interlock switch is associated with the second plunger for actuating the switch when the oven door is locked, whereby the self-cleaning oven cycle cannot be initiated without the oven door being latched so as to actuate the said interlock switch.

9. A high temperature self-cleaning oven as recited in claim 2 wherein the said latch mechanism has a supporting base plate that is assembled above the oven liner, the shifting pivot means of the latch arm comprising an upright bearing flange at the rear of the base plate having a pair of slots arranged in a generally horizontal plane, the rear end of the latch are having a spaced pair of plungers which extend into the slots and are guided thereby for a rocking action with respect to the flange, one plunger being generally in alignment with the latch arm for use as a bearing by the latch arm in its open position, and the second plunger being arranged off-center from the latch arm for use as a bearing by the latch arm in a position other than the open position, the latch arm being furnished with a return spring means which urges the latch arm toward its open position, and a fixed stop means on the base plate in the path of movement of the latch arm to prevent the travel of the latch arm beyond its fully closed position in the event the oven door is open.

10. A high temperature self-cleaning oven as recited in claim 9 wherein the said catch means is furnished with a stabilizing guide means into which the latch arm slides in the closed position, the catch means being a pivoted hook member that is supported from the guide means and is engageable over the far edge of the latch arm to confine it within the guide means.

11. A high temperature self-cleaning oven as recited in claim 10 wherein the said catch means includes an over-center spring means for urging the catch to either of its two extreme positions, the catch means also including adjustable calibration means for cooperation with the said thermally responsive means.

12. A high temperature self-cleaning oven as recited in claim 11 wherein the said oxidation unit is provided with a resistance heating element that is energized only during a self-cleaning oven cycle, the said thermally responsive means being a cantilever bimetal blade that is supported from the housing of the oxidation unit and has its free end interposed between the said adjustable calibration means of the catch means.

13. In an oven including a box like oven liner, one wall of which is movable to provide access to the interior of said oven, said movable wall being carried by a hinged door, one margin of said door being hinged, and the opposite margin provided with a keeper, an improved door latching mechanism comprising a latch member extending across substantially the entire depth of said oven and having a handle portion extending frontwardly beyond the liner, said member being pivotable about two pivot points adjacent the rear wall of said liner, and movable between an open position out of engagement with said keeper and a closed position in engagement with said keeper, a tension spring coupled to said member for applying a constant rearward bias to said member, said spring being loaded by movement of said member to said closed position to thereby transfer said bias to the door of said oven through said keeper.

14. The combination recited in claim 13 wherein said spring operates as a toggle to urge said member toward said one of said pivot points when it is in the open position and toward the other of said pivot points when in said closed position.

15. The combination recited in claim 13 further including a locking mechanism for preventing movement of said member from said closed to said open position when oven temperatures are above about 600° F.

* * * * *